US007750861B2

(12) United States Patent
Delgado et al.

(10) Patent No.: US 7,750,861 B2
(45) Date of Patent: Jul. 6, 2010

(54) HYBRID ANTENNA INCLUDING SPIRAL ANTENNA AND PERIODIC ARRAY, AND ASSOCIATED METHODS

(75) Inventors: Heriberto J. Delgado, Melbourne, FL (US); Arecio A. Hernandez, Melbourne, FL (US); David G. Hoyt, Satellite Beach, FL (US)

(73) Assignee: Harris Corporation, Melbourne, FL (US)

( * ) Notice: Subject to any disclaimer, the term of this patent is extended or adjusted under 35 U.S.C. 154(b) by 380 days.

(21) Appl. No.: 11/748,788

(22) Filed: May 15, 2007

(65) Prior Publication Data

US 2008/0284673 A1 Nov. 20, 2008

(51) Int. Cl.
*H01Q 21/00* (2006.01)

(52) U.S. Cl. ..... 343/725; 343/701

(58) Field of Classification Search ..... 343/795, 343/700 MS, 725, 701–702, 895
See application file for complete search history.

(56) References Cited

U.S. PATENT DOCUMENTS

| | | | | |
|---|---|---|---|---|
| 4,309,706 | A | 1/1982 | Mosko | 343/100 |
| 4,525,720 | A | 6/1985 | Corzine et al. | 343/895 |
| 5,053,786 | A | 10/1991 | Silverman et al. | 343/895 |
| 5,990,849 | A | 11/1999 | Salvail et al. | 343/895 |
| 6,023,250 | A | 2/2000 | Cronyn | 343/895 |
| 6,028,567 | A * | 2/2000 | Lahti | 343/895 |
| 6,067,058 | A | 5/2000 | Volman | 343/895 |
| 6,191,756 | B1 | 2/2001 | Newham | 343/895 |
| 6,266,027 | B1 | 7/2001 | Neel | 343/895 |
| 6,353,443 | B1 | 3/2002 | Ying | 345/702 |
| 6,407,721 | B1 | 6/2002 | Mehen et al. | 343/895 |
| 6,489,925 | B2 * | 12/2002 | Thursby et al. | 343/700 MS |
| 6,741,213 | B2 * | 5/2004 | Jenwatanavet | 343/700 MS |
| 6,750,828 | B1 | 6/2004 | Wixforth et al. | 343/895 |
| 6,791,497 | B2 | 9/2004 | Winebrand et al. | 343/702 |
| 6,842,157 | B2 | 1/2005 | Phelan et al. | 343/893 |
| 6,987,392 | B1 | 1/2006 | Hernandez et al. | 324/627 |
| 7,002,522 | B2 * | 2/2006 | Kim et al. | 343/702 |
| 7,071,889 | B2 * | 7/2006 | McKinzie et al. | 343/756 |
| 2004/0080465 | A1 * | 4/2004 | Hendler et al. | 343/795 |

OTHER PUBLICATIONS

IEEE abstract, Mosallaei et al., "Antenna Miniaturization and Bandwidth Enhancement Using a Reactive Impedance Substrate", vol. 52, Issue 9 published Sep. 2004.

IEEE abstract, Kern et al., "The Design Synthesis of Multiband Artificial Magnetic Conductors Using High Impedance Frequency Selective Surfaces", vol. 53, Issue 1 published Jan. 2005.

* cited by examiner

*Primary Examiner*—Huedung Mancuso
(74) *Attorney, Agent, or Firm*—Allen, Dyer, Doppelt, Milbrath & Gilchrist, P.A. Attorneys at Law

(57) ABSTRACT

The hybrid antenna includes a spiral antenna, e.g. a log spiral antenna, and a patch array layer adjacent to the spiral antenna and including a passive periodic patch array of conductive patch elements. A conductive ground plane may be adjacent to the patch array layer, and a dielectric layer may be between the conductive ground plane and the patch array. The spiral antenna may include an upper antenna arm, a lower antenna arm and a dielectric sheet therebetween. Each of the upper and lower antenna arms may be a printed planar conductive trace that is wider at a distal end thereof with respect to a center of the log spiral antenna. The patch or periodic array layer operates in conjunction with the ground plane to couple energy into the spiral antenna and thereby improve low frequency antenna efficiency while maintaining electrically small dimensions.

23 Claims, 4 Drawing Sheets

HYBRID ANTENNA INCLUDING SPIRAL ANTENNA AND PERIODIC ARRAY, AND ASSOCIATED METHODS

FIELD OF THE INVENTION

The present invention relates to the field of communications, and, more particularly, to antennas and related methods for wireless communications.

BACKGROUND OF THE INVENTION

To protect the circuit components of electronic equipment from potentially damaging electromagnetic radiation, such as an externally-sourced electromagnetic pulse (EMP) or other interference signals such as radar, broadcast radio and TV, Cellular Phone, etc., it is customary practice to house the equipment within some form of shielded structure such as a cabinet, or enclosure, for example. An adjunct to this shielding structure is the need to verify its shielding effectiveness, once the equipment has been deployed at a host facility. Up to the present, it has been conventional practice to conduct only 'acceptance' testing of the shielding for densely populated enclosures within a laboratory environment at the factory, and then assume that once it has passed the acceptance test, the shielding structure's effectiveness will be sustained in the equipment's deployed environment.

However, there is a government agency 'verification' requirement (MIL-STD-188-125) that mandates the ability to test the shielding effectiveness of the protective structure subsequent to deployment of the equipment at a host facility, and such testing can be difficult or impossible due to the lack of room inside a densely populated shielded structure. This strict verification requirement creates a two-fold problem that is typically encountered when attempting to conduct on-site testing of the electromagnetic radiation shielding-effectiveness of the protective enclosure.

Firstly, there is usually very little, if any, room inside the equipment cabinet to install testing hardware and its associated antenna, particularly once the cabinet has been integrated with other units at a host site, such as a commercial communication facility. Secondly, it is necessary that signals emitted by the testing apparatus not interfere with the operation of other electronic circuitry that may be located within the same environment as the electronic circuitry under test. Indeed, commercial telecommunication providers customarily refuse to allow the use of RF radiating test equipment in their facilities for fear that the testing might interrupt service.

A low profile, near field, radiation efficient decade bandwidth antenna is needed for implementing Electromagnetic Protection Test and Surveillance System (EPTSS) technology, such as for use with the system disclosed in U.S. Pat. No. 6,987,392 to Harris Corporation of Melbourne, Fla. EPTSS may require efficient RF radiation in close proximity to conductive surfaces and equipment inside relatively small shielded equipment enclosures. There is currently no commercially available antenna technology to meet all EPTSS requirements. There are presently no decade-bandwidth small antennas that radiate efficiently in close proximity to conductive surfaces.

Log Periodic antennas (LPA) have been used inside large shielded enclosures for shielding effectiveness tests, however their form factor is incompatible with small enclosures. Log periodic antennas operate over a broad frequency range. Generally log periodic antennas have a plurality of dipole elements in a planar spaced array. The length of the elements and the spacing between the elements are selected in accordance with a mathematical formula, with the shortest elements being near the top of the antenna. Feed conductors generally connect at the tip of the antenna. Electrical connections from feed conductors to opposed elements are alternated to provide a 180 degree phase shift between successive elements.

U.S. Pat. No. 5,093,670 to Braathen discloses a log periodic antenna formed by printed circuit board manufacturing methods onto an insulative substrate. The dipole elements and one feed conductor are formed on one side of the substrate and a second feed conductor is formed on the opposite side of the substrate. Vias through the substrate connect the second feed conductor to alternating opposed dipole elements.

U.S. Pat. No. 5,917,455 to Huynh et al. discloses an array of log periodic antennas mounted on a backplane. Each antenna includes two flat dipole strips of conductive material with bases of the dipole strips mounted to the backplane in a spaced configuration. Each antenna is fed by a coaxial feed line with the center conductor being connected to one dipole strip and the jacket conductor being connected to the other dipole strip.

Classic spiral antenna configurations may have a good form factor. For example, U.S. Pat. No. 4,309,706 to Mosko entitled "Wideband Direction-Finding System", U.S. Pat. No. 4,525,720 to Corzine et al. and entitled "Integrated Spiral Antenna and Printed Circuit Balun", U.S. Pat. No. 5,990,849 to Salvail et al. and entitled "Compact Spiral Antenna" and U.S. Pat. No. 6,067,058 to Volman entitled "End-Fed Spiral Antenna, and Arrays Thereof" disclose various spiral antennas, however they are physically too large for use with EPTSS, and are not optimal for near field applications.

Additional spiral antennas are also shown in U.S. Pat. No. 6,191,756 to Newham, U.S. Pat. No. 6,266,027 to Neel, U.S. Pat. No. 6,407,721 to Mehen et al. and U.S. Pat. No. 6,750,828 to Wixforth et al. These antennas may not meet all EPTSS requirements, and there are presently no decade-bandwidth small antennas that radiate efficiently in close proximity to conductive surfaces, such as for use with EPTSS.

SUMMARY OF THE INVENTION

In view of the foregoing background, it is therefore an object of the present invention to provide an electrically small decade-bandwidth antenna that radiates efficiently in close proximity to conductive surfaces.

This and other objects, features, and advantages in accordance with the present invention are provided by a hybrid antenna including a spiral antenna, e.g. a log spiral antenna, and a periodic passive patch array layer adjacent the spiral antenna and including a passive periodic patch array of conductive elements. A conductive ground plane may be adjacent to the passive patch array layer, and a dielectric layer may be between the conductive ground plane and the passive patch array.

The log spiral antenna may include an upper antenna arm, a lower antenna arm and a dielectric sheet between them. Each of the upper and lower antenna arms may be a printed planar conductive trace that is wider at a distal end thereof with respect to a center of the log spiral antenna. A feed point may be adjacent the distal end of the lower antenna arm, and an antenna feed structure may be connected at the feed point. The feed structure may include a coaxial connector including an outer conductor connected to the lower antenna arm and an inner conductor connected to the upper antenna arm through the dielectric sheet.

A Radio Frequency (RF) absorber layer may be positioned between the ground plane and the dielectric layer. Also, the passive patch array of conductive elements may be a periodic array of printed conductive patch elements on a dielectric sheet.

A method aspect is directed to making a hybrid antenna including providing a spiral antenna, e.g. a log spiral antenna, and positioning a passive patch array layer adjacent the spiral antenna including forming a passive patch periodic array of conductive elements. A conductive ground plane is positioned adjacent the passive patch array layer, and a dielectric layer may be placed between the conductive ground plane and the passive patch array. Forming the patch array of conductive elements may include printing an array of conductive patch elements on a dielectric sheet.

The log spiral antenna may include an upper antenna arm on a dielectric sheet and a lower antenna arm on an opposite side of the dielectric sheet. Furthermore, forming each of the upper and lower antenna arms may comprise printing, on the dielectric sheet, a planar conductive trace that is wider at a distal end thereof with respect to a center of the log spiral antenna. An antenna feed structure may be connected at a feed point adjacent the distal end of the lower antenna arm including connecting a coaxial connector with an outer conductor connected to the lower antenna arm and an inner conductor connected to the upper antenna arm through the dielectric sheet.

DETAILED DESCRIPTION OF THE PREFERRED EMBODIMENTS

Figure 1:
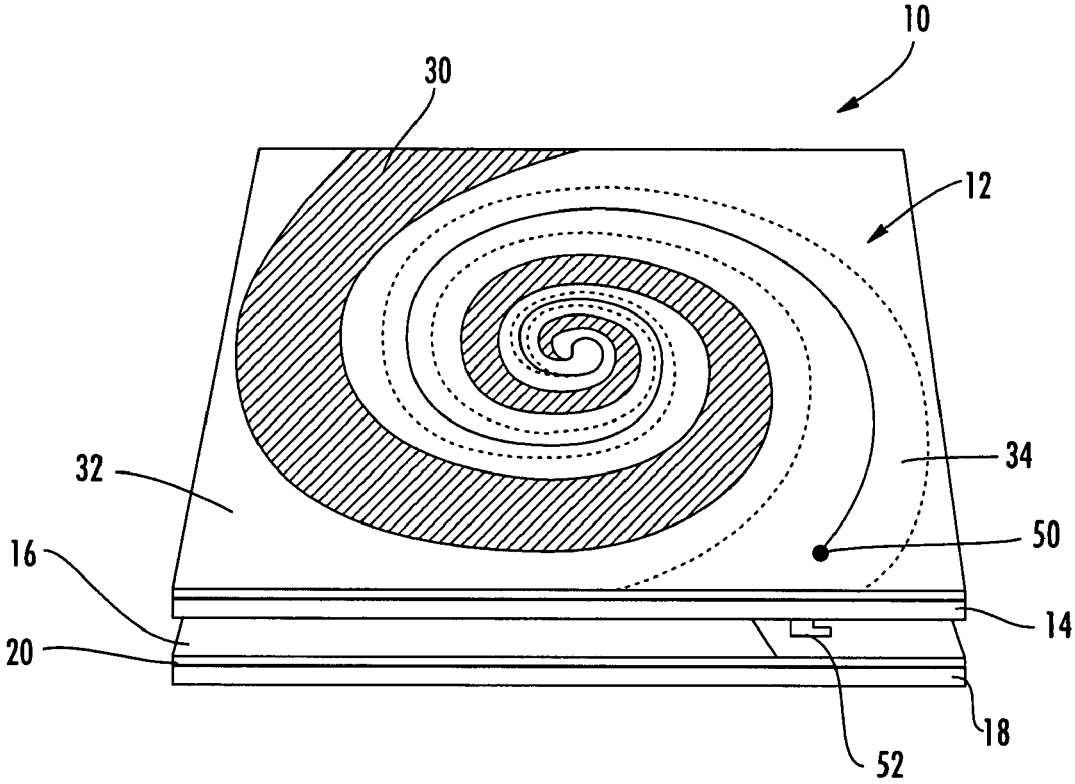
FIG. 1 is a perspective view of a hybrid antenna according to an aspect of the present invention.
Figure 2:
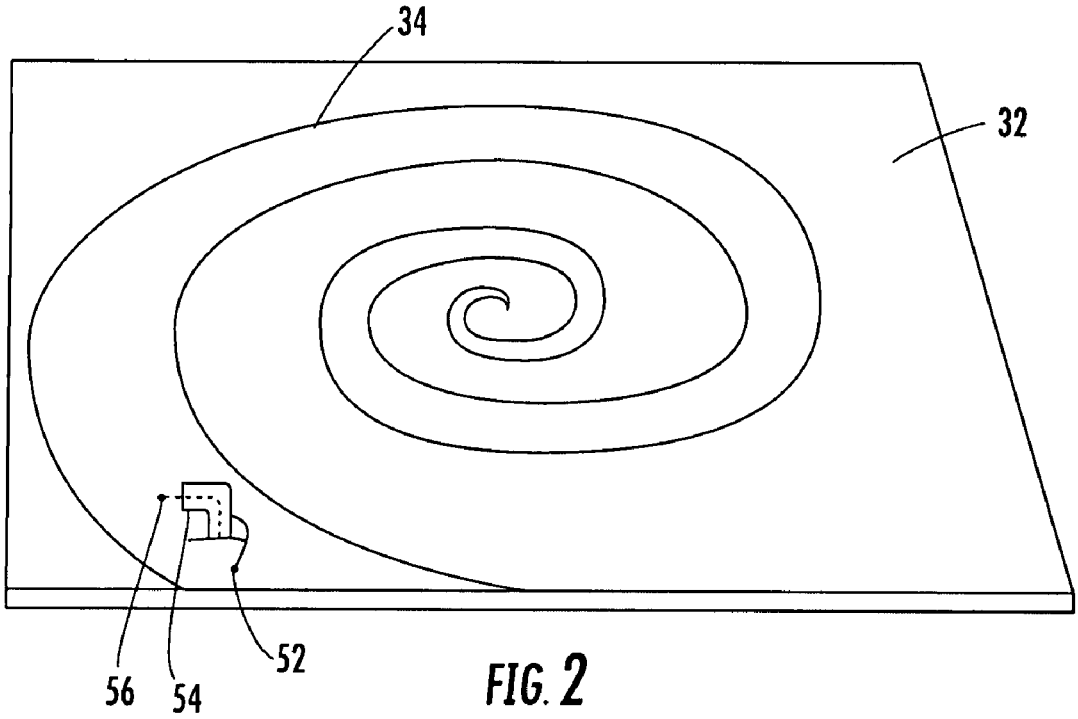
FIG. 2 is a bottom view of the spiral antenna structure of the hybrid antenna of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. In the figures, the dimensions of layers and regions are exaggerated for clarity. It will also be understood that when a layer, sheet or region is referred to as being "on" another element, it can be directly on the other element or intervening layers, sheets or regions that may be present.

As discussed above, EPTSS may require efficient RF radiation in close proximity to conductive surfaces and equipment inside relatively small shielded equipment enclosures. There are presently no decade-bandwidth antennas that radiate efficiently in close proximity to conductive surfaces, such as for use with EPTSS.

Referring to FIGS. 1-5, a hybrid antenna 10 in accordance with an aspect of the present invention will now be described. The hybrid antenna 10 includes a spiral antenna 12, e.g. a log spiral antenna, and a passive periodic patch array layer 14 adjacent the spiral antenna and including a periodic array of conductive patch elements 60. A conductive ground plane 18 may be adjacent the patch array layer 14, and a dielectric layer 16 (e.g. a low RF loss dielectric material such as foam insulation) may be placed between the conductive ground plane and the patch array.

Figure 3:
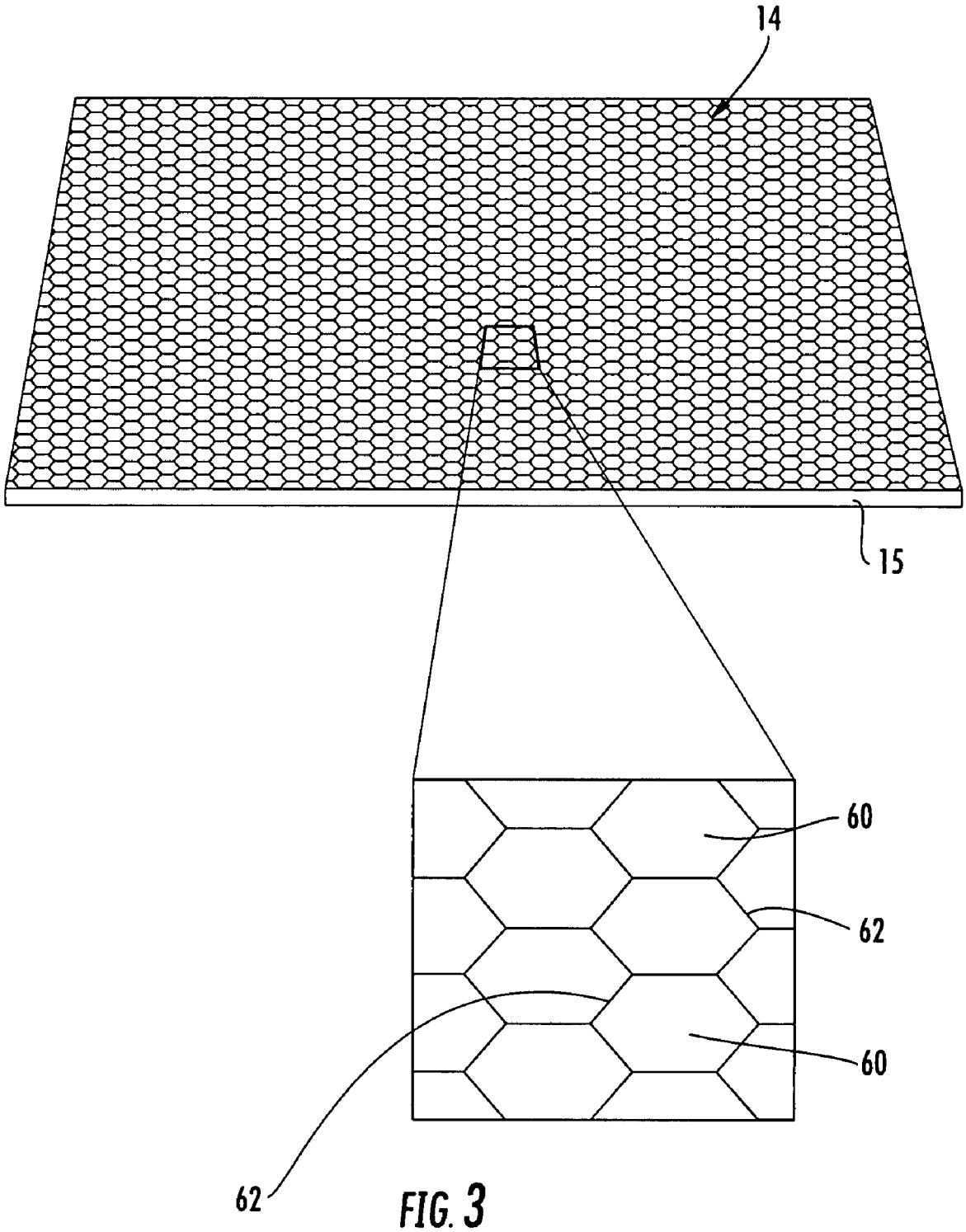
FIG. 3 is a perspective view including an enlarged portion of the passive periodic patch array layer of the hybrid antenna of FIG. 1.

As illustrated in FIG. 3, the periodic array layer 14 of conductive elements 60 may be an array of printed conductive passive patch elements (e.g. hexagon shaped metallic patch elements, as shown) on a dielectric sheet 15 with gaps 62 therebetween. Other geometries of the patch elements 60 may be used as would be appreciated by those skilled in the art (e.g. squared and circular patches). The conductive elements 60 may be all identical or substantially identical and may repeat periodically or aperiodically depending on particular requirements of the application. The periodic array layer 14 operates in conjunction with the ground plane 18 to couple energy into the spiral antenna 12 and thereby improve low frequency antenna efficiency while maintaining electrically small dimensions.

The log spiral antenna 12 may include an upper antenna arm 30, a lower antenna arm 34 and a dielectric sheet 32 therebetween. Referring specifically to the perspective view illustrated in FIG. 1, it is shown that each of the upper 30 and lower 34 (indicated by the dashed line) antenna arms may be a printed planar conductive trace that is wider at a distal end thereof with respect to a center of the log spiral antenna. Other spiral antenna structures may be used based upon desired characteristics and the specific application, as would be appreciated by those skilled in the art. As illustrated, the thin portions of the antenna arms 30, 34 near the center of the spiral radiate at the high end of the frequency band while the wider portions radiate at the lower end of the frequency band. This may contribute to the decade bandwidth (i.e. 10:1) of the hybrid antenna 10.

A feed point 50 may be adjacent the distal end of the lower antenna arm 34, i.e. the feed point 50 is preferably placed at the low frequency portion (the wider portion) of the spiral lower antenna arm 34. An antenna feed structure 52 may be connected at the feed point 50. The feed structure 52 may be a coaxial connector including an outer conductor 54 connected to the lower antenna arm 34 and an inner conductor 56 connected to the upper antenna arm 30 through the dielectric sheet 32. Such a low frequency feed or balun may use spiral conductive lines or traces on front and rear sides of the dielectric sheet 32 and is insensitive to high frequency scattering occurring at higher frequencies thus providing for decade bandwidth radiation and input impedance matching.

Figure 5:
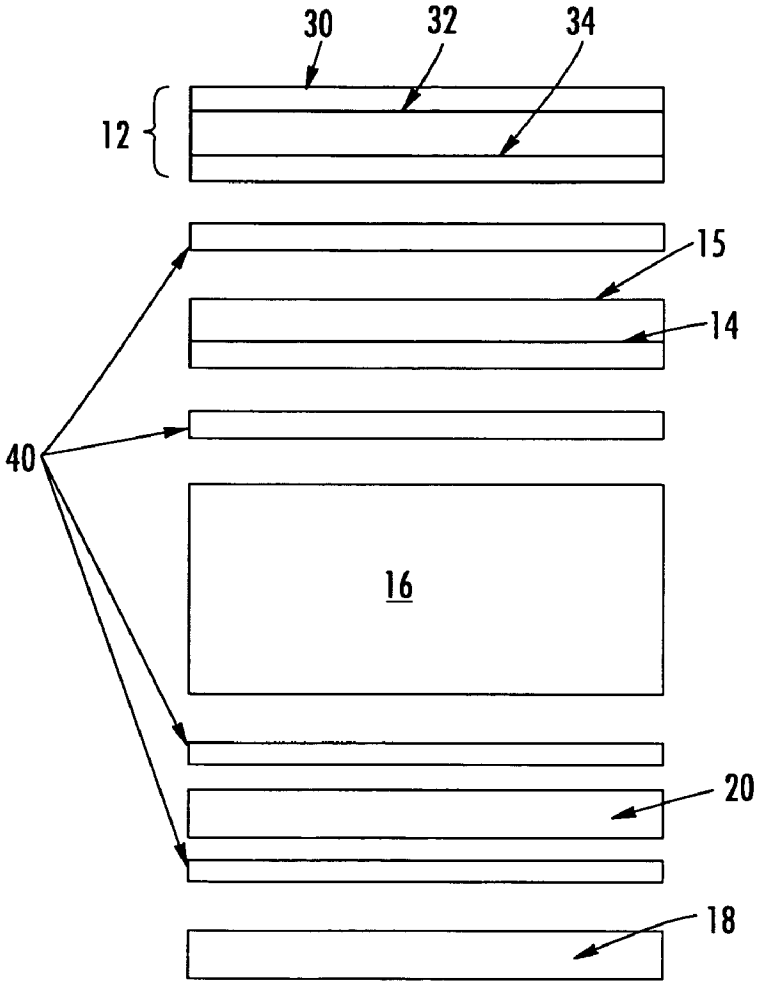
FIG. 5 is an exploded view of the hybrid antenna of FIG. 4.
Figure 4:
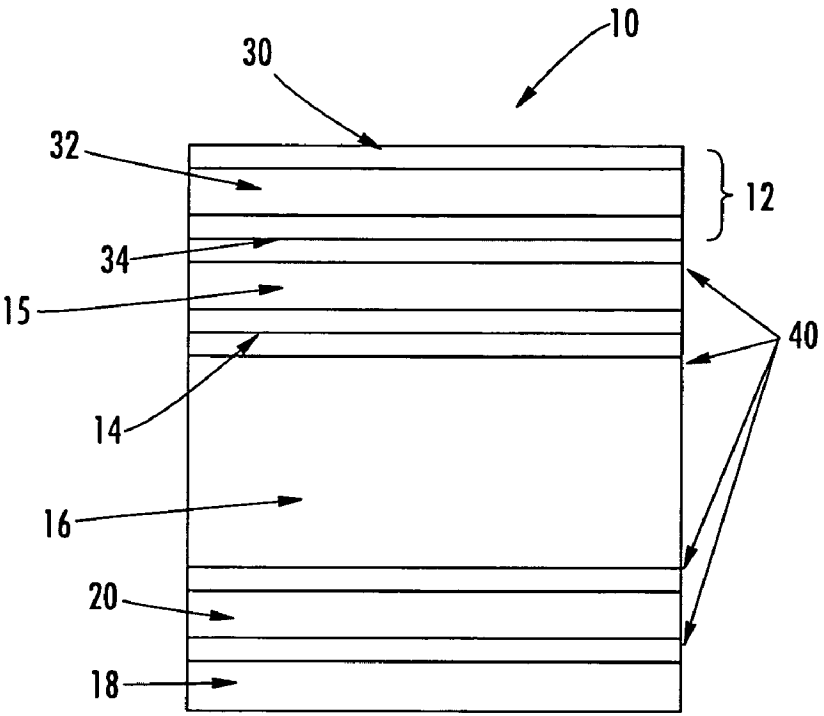
FIG. 4 is an elevation cross-sectional view of the hybrid antenna of FIG. 1.

A Radio Frequency (RF) absorber layer 20 may be positioned between the ground plane 18 and the dielectric layer 16. The RF absorber layer 20 preferably has electromagnetic properties that are selected for the specific implementation. Additionally, as illustrated in FIGS. 4 and 5, adhesive layers 40 may be included to securely position the layers or sheets relative to one another.

As the size of a conventional spiral antenna (with associated ground plane) decreases, the radiation efficiency also decreases at the low end of the frequency band. A standalone ground plane reflects most of the energy with a phase shift of 180 degrees. To compensate for the resulting canceling phenomenon, the present invention combines a passive periodic array layer 14, e.g. low pass filter periodic array, with the ground plane 18 and/or RF absorber layer 20. When the periodic array 14 is placed near the ground plane 18 in close proximity to the spiral antenna structure 12, the reflected phase angle of the incident or radiated fields may approach zero degrees, thus adding constructively in phase with the antenna incident or radiated fields. This in phase combination of incident and reflected fields may induce a surface current along the periodic array structure 14 and the log spiral antenna arms 30 and 34 which may increase antenna radiation efficiency.

Accordingly, there may be an antenna size reduction factor associated with interaction between the log spiral antenna 12 and periodic array 14 antenna structures. The size reduction factor may depend on the specific periodic surface lattice, patch element geometry, dielectric materials and number of periodic surfaces and/or dielectric layers. For example, good results have been achieved with a size reduction factor of two.

Conventionally, a reflector or perfectly electric conducting (PEC) ground plane may be typically placed $\lambda/4$ (a quarter of a wavelength at the start frequency) from a spiral antenna to form a cavity with walls between and around the antenna and the reflector. However, the actual reflector distance from the spiral antenna to the reflector (e.g. ground plane 18 and RF absorber layer 20) in the present invention is preferably about $0.01\lambda$. This distance is much smaller than in such conventional spiral antennas.

The reflector converts the bi-directional radiation into a uni-directional beam. The RF absorber layer increases the antenna bandwidth but reduces the antenna efficiency, since some of the power is dissipated in the absorber. If the absorber is not used, antenna efficiency increases but bandwidth may decrease. Also, during a high impedance state of the periodic patch array, the reflector reflected field and the spiral antenna incident field are in phase.

The fields reflected from the ground plane and RF absorber layer are altered by the presence of the passive periodic patch array which creates an impedance surface. The patch array in the presence of the ground plane and the RF absorber layer produces a surface impedance associated with a zero reflection coefficient phase at some frequency bands (especially at the low end of the band). A zero reflection coefficient phase at the patch array surface means that the incident fields on the antenna are in phase with the fields reflected from the absorbing reflector and the surface impedance is relatively large.

The zero reflection coefficient allows the patch array to be placed adjacent to the spiral antenna, which in turn radiates efficiently. Reflection coefficient phases between $-90°$ and $90°$ provide a reasonable frequency band over which the reflector and antenna fields add up coherently (high impedance region).

Below resonance the reflection coefficient phase is greater than zero, and the surface impedance is inductive. Above resonance the reflection coefficient phase is less than zero, and the surface is capacitive. Multiple frequency resonances, with associated high impedance, inductive and capacitive regions, may be present in this invention. The spiral antenna may experience higher efficiency in the high impedance region, as reflected ground currents add in phase with antenna currents. In the frequency regions that support transverse electric (TE) and transverse magnetic (TM) surface waves, the induced currents couple to the spiral antenna arms and are radiated.

When the patch array is placed next to the spiral antenna, additional capacitance is generated, due to the increased coupling between patch elements resulting in the shifting of the resonance down in frequency, thus resulting in a size reduction for both structures. For example, when the resonance moves down from 900 MHz to 450 MHz, a size reduction factor of 2 is achieved. This means that both the spiral antenna and patch array designed to operate originally at 900 MHz, can now operate at 450 MHz.

A method aspect is directed to making a hybrid antenna 10 including providing a spiral antenna 12, e.g. a log spiral antenna, and positioning a passive patch periodic array layer 14 adjacent to the spiral antenna and forming the patch array with conductive patch elements 60. A conductive ground plane 18 is positioned adjacent the patch array layer 14, and a dielectric layer 16 is placed between the conductive ground plane and the patch array. Forming the patch array 14 with conductive elements 60 may include printing a periodic array of conductive patch elements on a dielectric sheet 15.

Constructing the log spiral antenna 12 may include forming an upper antenna arm 30 on a dielectric sheet 32 and forming a lower antenna arm 34 on an opposite side of the dielectric sheet. Furthermore, forming each of the upper and lower antenna arms 30, 34 may comprise printing, on the dielectric sheet 32, a planar conductive trace that is wider at a distal end thereof with respect to a center of the log spiral antenna 12. An antenna feed structure 52 may be connected at a feed point 50 adjacent to the distal end of the lower antenna arm 34 including connecting a coaxial connector with an outer conductor 54 connected to the lower antenna arm 34 and an inner conductor 56 connected to the upper antenna arm 30 through the dielectric sheet 32.

The approach of the described embodiments may maintain radiation efficiency over a decade bandwidth (10:1) or more in close proximity to conductive and non-conductive surfaces. These embodiments may result in a significant a size reduction relative to conventional log spiral antenna technology.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A hybrid antenna comprising:

a spiral antenna comprising an upper log spiral antenna arm, a lower log spiral antenna arm and a dielectric sheet therebetween;

a patch array layer adjacent the spiral antenna and including an array of conductive elements;

a conductive ground plane adjacent the patch array layer; and a dielectric layer between the conductive ground plane and the patch array.

2. The hybrid antenna according to claim 1 wherein the spiral antenna comprises at least one log spiral antenna arm.

3. The hybrid antenna according to claim 1 wherein each of the upper and lower log spiral antenna arms comprises a printed planar conductive trace that is wider at a distal end thereof with respect to a center of the log spiral antenna.

4. The hybrid antenna according to claim 3 wherein the spiral antenna further comprises a feed point adjacent the distal end of the lower log spiral antenna arm.

5. The hybrid antenna according to claim 4 further comprising an antenna feed structure connected at the feed point and comprising a coaxial connector including an outer conductor connected to the lower log spiral antenna arm and an inner conductor connected to the upper log spiral antenna arm through the dielectric sheet.

6. The hybrid antenna according to claim 1 further comprising a Radio Frequency (RF) absorber layer positioned between the ground plane and the dielectric layer.

7. The hybrid antenna according to claim 1 wherein the patch array of conductive elements comprises a periodic array of printed conductive patch elements on a dielectric sheet.

8. A hybrid antenna comprising:

a spiral antenna including an upper arm, a lower arm and a first dielectric sheet therebetween; and a periodic array layer adjacent to the spiral antenna and including a periodic array of conductive elements on a second dielectric sheet.

9. The hybrid antenna according to claim 8 further comprising:

a conductive ground plane adjacent to the periodic array layer;

a dielectric layer between the conductive ground plane and the periodic array layer; and an RF absorber layer between the dielectric layer and the conductive ground plane.

10. The hybrid antenna according to claim 8 wherein each of the upper and lower antenna arms comprises a printed planar conductive trace that is wider at a distal end thereof with respect to a center of the spiral antenna.

11. The hybrid antenna according to claim 10 further comprising an antenna feed structure connected at a feed point adjacent the distal end of the lower antenna arm and comprising a coaxial connector including an outer conductor connected to the lower antenna arm and an inner conductor connected to the upper antenna arm through the dielectric sheet.

12. The hybrid antenna according to claim 8 wherein the periodic array of conductive elements comprises a periodic array of printed conductive patch elements on the second dielectric sheet.

13. A method of making a hybrid antenna comprising:

providing a spiral antenna including forming an upper log spiral antenna arm on a dielectric sheet and forming a lower log spiral antenna arm on an opposite side of the dielectric sheet;

positioning a patch array layer adjacent the spiral antenna including forming a patch array of conductive elements;

providing a conductive ground plane adjacent the patch array layer; and providing a dielectric layer between the conductive ground plane and the patch array.

14. The method according to claim 13 wherein forming each of the upper and lower log spiral antenna arms comprises printing, on the dielectric sheet, a planar conductive trace that is wider at a distal end thereof with respect to a center of the spiral antenna.

15. The method according to claim 13 further comprising positioning a Radio Frequency (RF) absorber layer between the ground plane and the dielectric layer.

16. The method according to claim 13 wherein forming the patch array of conductive elements comprises printing a periodic array of conductive patch elements on a dielectric sheet.

17. A method of making a hybrid antenna comprising:

providing a spiral antenna including forming an upper arm and a lower arm on opposite sides of a first dielectric sheet; and positioning a periodic array layer adjacent the spiral antenna and including forming a periodic array of conductive elements on a second dielectric sheet.

18. The method according to claim 17 further comprising:

providing a conductive ground plane adjacent the periodic array layer;

providing a dielectric layer between the conductive ground plane and the periodic array; and providing an RF absorber layer between the dielectric layer and the conductive ground plane.

19. The method according to claim 17 wherein forming each of the upper and lower antenna arms comprises printing a planar conductive trace that is wider at a distal end thereof with respect to a center of the spiral antenna.

20. The hybrid antenna according to claim 19 further comprising connecting an antenna feed structure at a feed point adjacent the distal end of the lower antenna arm and comprising a coaxial connector including an outer conductor connected to the lower antenna arm and an inner conductor connected to the upper antenna arm through the dielectric sheet.

21. The hybrid antenna according to claim 17 wherein forming the periodic array of conductive elements comprises forming a periodic array of printed conductive patch elements on the second dielectric sheet.

22. A hybrid antenna comprising:

a spiral antenna;

a patch array layer adjacent the spiral antenna and including an array of conductive elements;

a conductive ground plane adjacent the patch array layer;

a dielectric layer between the conductive ground plane and the patch array; and a Radio Frequency (RF) absorber layer positioned between the ground plane and the dielectric layer.

23. A method of making a hybrid antenna comprising:

providing a spiral antenna including forming an upper log spiral antenna arm on a dielectric sheet and forming a lower log spiral antenna arm on an opposite side of the dielectric sheet;

positioning a patch array layer adjacent the spiral antenna including forming a patch array of conductive elements;

providing a conductive ground plane adjacent the patch array layer;

providing a dielectric layer between the conductive ground plane and the patch array; and positioning a Radio Frequency (RF) absorber layer between the conductive ground plane and the dielectric layer.

* * * * *